US005812170A

United States Patent [19]

Kuehnle et al.

[11] Patent Number: 5,812,170

[45] Date of Patent: Sep. 22, 1998

[54] ELECTROSTATIC PRINTING METHOD AND APPARATUS EMPLOYING A WHISKER WRITE HEAD

[75] Inventors: Manfred R. Kuehnle, New London, N.H.; Hermann Statz, Wayland, Mass.

[73] Assignee: Heidelberger Druckmaschinen AG, Heidelberg, Germany

[21] Appl. No.: 593,598

[22] Filed: Jan. 29, 1996

[51] Int. Cl.[6] ..... G03G 15/01

[52] U.S. Cl. ..... 347/151; 347/147; 399/175

[58] Field of Search ..... 347/141, 147, 347/151; 219/216; 361/255; 399/175

[56] References Cited

U.S. PATENT DOCUMENTS

| | | | |
|---|---|---|---|
| 3,689,933 | 9/1972 | Klose . | |
| 4,233,611 | 11/1980 | Nakano et al. . | |
| 4,792,860 | 12/1988 | Kuehrle . | |
| 5,241,342 | 8/1993 | Asano et al. | 399/175 |
| 5,325,120 | 6/1994 | Kuehnle . | |
| 5,406,314 | 4/1995 | Kuehnle . | |
| 5,652,649 | 7/1997 | Ikegawa et al. | 399/175 |

FOREIGN PATENT DOCUMENTS 59-133073 7/1984 Japan .

OTHER PUBLICATIONS

"Low Voltage Electrography using Monocomponent Development," IBM Technical Disclosure Bulletin, vol. 33, No. 1A, Jun. 1990.

D. Stewart, P. Wilson, "Recent developments in broad area field emission cold cathodes," *Vacuum*, vol. 30 No. 11/12.

H.E. Cline, "Multineedle Emission from the Ni–W Eutectic," *Journal of Applied Physics*, vol. 41, No. 1 (Jan. 1970).

*Primary Examiner*—Stuart N. Hecker

*Attorney, Agent, or Firm*—Kenyon & Kenyon

[57] ABSTRACT

An electronic printing device is disclosed which uses flexible whiskers to transfer a charge corresponding to an image to a dielectric recording surface. The recording surface preferably has areas of differing conductivity so that microfields form on the dielectric surface. Ink, preferably non-charged, may then be attracted to the recording surface through dipole forces and later transferred to paper.

16 Claims, 3 Drawing Sheets

ELECTROSTATIC PRINTING METHOD AND APPARATUS EMPLOYING A WHISKER WRITE HEAD

FIELD OF THE INVENTION

This invention relates generally to electrothermal printing, and more particularly to a contact method and apparatus for depositing electrostatic charge on an image member.

BACKGROUND OF THE INVENTION

In electrothermal printing techniques, such as are outlined in U.S. Pat. Nos. 5,325,120 and 5,406,314, the entire contents of both of which are herein incorporated by reference, electrostatic charges are deposited onto a mildly ink-repellent recording surface of an image member to form an electrostatic pattern, comprising charged and uncharged areas, corresponding to an electronic image, to be reduced to visible form on a printing substrate. Electrostatic fields generated by the deposited charges overcome the inkophobic nature of the recording surface and attract ink onto the recording surface in accord with the electrostatic pattern. At each location on the pattern, the area-normalized amount, or thickness, of ink transferred from the ink supply onto the recording surface is proportional to the local field strength. Contact with the printing substrate completely transfers the developed image from the recording surface, leaving the recording surface ready for redevelopment or erasure of the electrostatic image.

The entire recording surfaces of the image members, as used in the technologies described in the above-referenced patents are of a dielectric material. The deposited electrostatic charges create charged pixel-wise regions on such surfaces. Another type of image member, described in commonly owned applications Ser. Nos. 08/467,200 and 469,323, the entire contents of which are hereby incorporated by reference, has an anisotropic recording surface so that deposited electrostatic charge produce nonuniform fields over the local recording surface corresponding to a pixel.

The use of microplasma recording to form the imagewise electrostatic charge patterns on an image member is compatible with either type of recording surface. Although microplasma recording is an effective and versatile technique, there are certain disadvantages associated with its implementation. A few examples of these are: high voltages are required to activate the field ignition ionization electrodes which produce the ion stream that establishes the electrostatic pattern; special precautions are necessary to avoid sputter erosion of the material used for the tunnels housing the field ignition electrodes and the ignition electrodes require a maintenance current to hold them in readiness even when no image transfer is occurring. These factors tend to increase the operating cost of such a printing apparatus.

Accordingly, for some applications, it would be desirable to provide an image recording technique that would not require use of field ignition ionization electrodes.

Moreover, direct contact writing with cantilevered metallic contacts having electric fingers, as described in the '200 and '323 applications, may lead to imperfect charging of the recording surface, which at a microscopic level can be rather rough. One reason for this is because the rigid contacts may "bounce" off the rough surface and not spring back in time to make contact for the desired electric transmission. The metal contacts described therein are also relatively brittle and therefore may break or fracture during long periods of use.

SUMMARY OF THE INVENTION

The present invention uses flexible conductive "whiskers" on the write head to physically contact the image member to transfer charge thereto and thereby form the imagewise electrostatic pattern thereon. The write head of the present invention is somewhat similar to the microplasma recording apparatus described in the above-referenced '120 patent, with the following major difference. The '120 patent reference discloses a write head having a series of ion-beam emitters, each of which charges a pixel region on the recording surface from across a gap under the influence of an image-member/write-head potential difference, whereas the write head of the present invention comprises an array of matrices or pads having a single whisker or a plurality of whiskers thereon, anchored to a conductive substrate and each matrix charged to imagewise-dependent voltages, which transfer charge to the recording surface by sliding physical contact therewith.

As used in this document, the term "whisker" refers to a strand of ultra-strong, ultra-hard, usually monocrystalline material. A plurality of whiskers may be grown in conjunction with similar parallel strands from a perpendicular conductive substrate. A matrix or pad may have a single whisker or, preferably, to establish better contact within a pixel area, a bundle of whiskers thereon. With a typical whisker having a diameter on the order of 2 microns, such a bundle may contain as many as 100 whiskers in an area or pad 50 microns square, as may correspond to one typical pixel on the recording surface. The whiskers may be grown by any of the methods known in the materials processing field and may be of any of several appropriate materials, such as tungsten or graphite. In addition to adequate electrical conductivity, whiskers for use in a writing head must be flexible and chemically stable.

The invention is practiced to best advantage when used with an image member having a recording surface with surface areas of differing conductivity, such as described in the above-referenced '200 and '323 applications. Such an image member may comprise a back or ground electrode covered by a thin dielectric layer with several isolated conductive regions, or islands, per pixel region on the surface. Contact of the recording surface by a charging member only occurs at a few points due to nonuniformity in recording surface and whisker topography, so that, in general, very little charge would be transferred to a generic plain dielectric recording surface during the contact time, and the electric fields generated between the charged and adjacent uncharged areas would be relatively weak. Although an array of many whiskers would improve the area coverage, this low charge-transfer efficiency might be limiting even for such a configuration. However, when the recording surface of the image member includes conductive islands, even a poor contact by only one whisker with a conductive island allows charging of that entire island to the potential of the whisker on a nanosecond time scale. On such a recording surface, strong nonuniform electric fields covering each pixel position are generated by edge effects at the periphery of each conductive island. These fields extend above the recording surface and fall of rapidly with distance away from the island. The field strength around each island, then, is a function of the imagewise potential of the whisker that deposited the charge on that island. The imagewise potential for each whisker is chosen such that the aggregate of the field strengths around each island results in a macroscopic field strength over the pixel which is a monotonic function of the gray-scale or color value at the corresponding location in the electronic image.

When such a charged recording surface is disposed opposite a source of dielectric developing medium, preferably non-charged ink, the electric fields induce an electric dipole moment in the medium through dielectric polarization and the medium is drawn to the charged areas of the recording surface dielectrophoretically in amounts proportional to the strengths of the respective fields. Thus, the developing medium will accumulate around each island in an amount that increases monotonically with the field intensity at that location, thereby developing the electronic image recorded on the image member. However, charged inks may also be used so that the charged ink is attracted to the recording surface through the principle of charge compensation. While it may reduce the efficiency of the electrical contact between the whiskers and the metallized areas on the dielectric surface, both the dielectric and conductive regions of the image member also may be covered with an ink-abhesive coating to ensure that ink only adheres to the surface in accordance with the deposited imagewise electrostatic pattern, thus promoting a sharp rendition of the image when the ink is transferred to the printing substrate.

BRIEF DESCRIPTION OF THE DRAWINGS

The foregoing discussion will be understood more readily from the following detailed description of the invention, when taken in conjunction with the accompanying drawings, in which.

It will appreciated that, for purposes of illustration, these figures are not necessarily drawn to scale.

DETAILED DESCRIPTION

Figure 1:
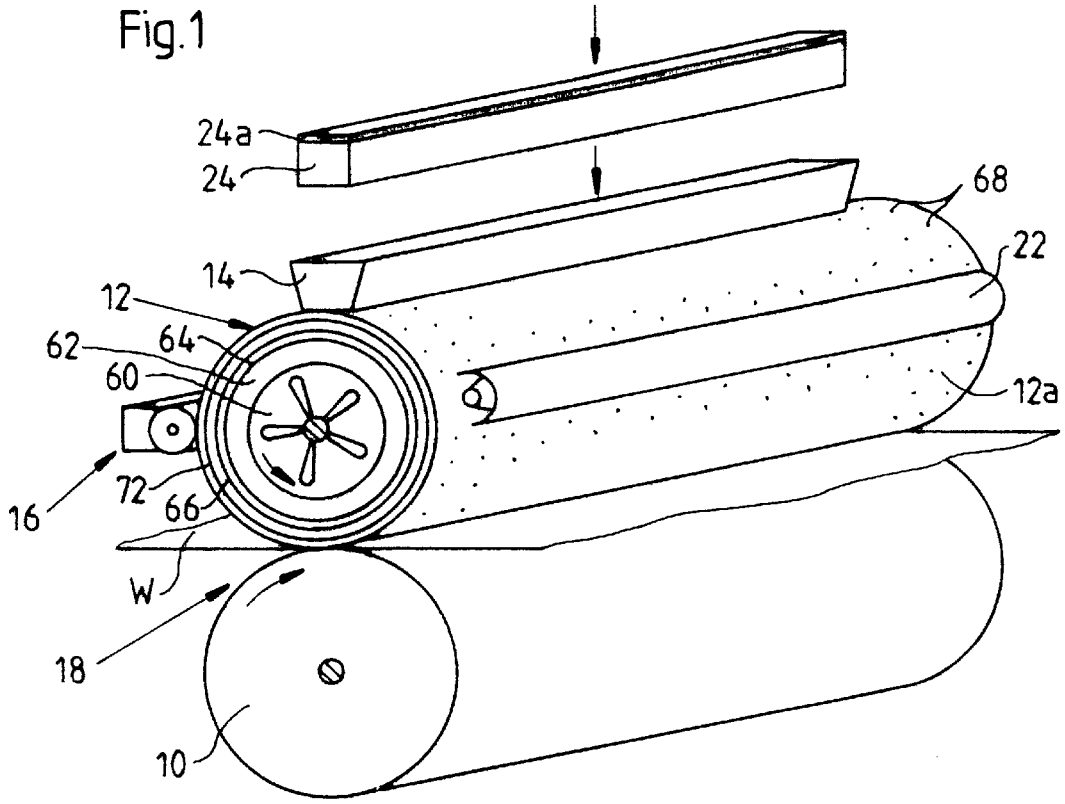
FIG. 1 is an isometric view of printing apparatus including a write head of the invention.

FIG. 1 of the drawings shows a printing apparatus according to the invention, including a rotary paper cylinder 10 for supporting a printing substrate such as a paper web W. Positioned parallel to cylinder 10 is an image member 12 which is arranged so that the web W passes through a nip formed between the cylinder 10 and image member 12. Disposed around image member 12 are an electronic write head 14 having whisker containing charge members, an inking head 16 which presents a dielectric, electrically neutral ink to the image member 12, an ink transfer station 18 constituted by the cylinder nip between the image member 12 and the inking head 16, and an erase head 22 all of whose functions are controlled by a controller 24.

Controller 24 receives input signals as a digital data stream representing the gray scale or color values of an image to be reproduced ultimately on the web. In the case of a color press, FIG. 1 represents one print unit for printing one color component or signature of an original document, e.g., the cyan component. For a 4-color press, there would be three more print units located downstream from cylinder 12 for printing the other color components, namely, magenta, yellow and black, as shown, for example, in U.S. Pat. No. 4,792,860, the entire contents of which are hereby incorporated herein by reference. Alternatively, the FIG. 1 apparatus, modified to include a plural color inking station, may print all four color signatures by itself, as described, for example, in the above-referenced '120 patent.

The data representing the various color components of a color original are applied to the apparatus in successive strings. For example, the system may receive the data in the order cyan, magenta, yellow and black. Preferably, a mass memory 24*a* is associated with controller 24 for storing the relatively large amount of data necessary to operate the apparatus.

In order to print on web W, controller 24 controls the write head 14 so that, as the image member 12 rotates, the write head 14 records on the image member recording surface 12*a* electrostatic images corresponding to at least one of the color components represented in the input data stream.

The inking head 16 may be similar to the one described in the '860 or '120 patent referenced above, which supplies, in a molten state, thermoplastic ink composed of pigment particles in one of the four printing colors dispersed in a binder. The image member recording surface 12*a* may be covered thinly with a mildly inkophobic material so that ink does not tend to adhere to the surface of the image member except at those locations which are charged by the write head 14. For example, if a cyan image is being written on image member 12, the inking head 16 will dispense cyan ink. Resultantly, when the electrostatic image on the recording surface 12*a* has advanced past the inking head 16, cyan ink from head 16 will be acquired by the charged areas of that image thereby developing a cyan image on the image member recording surface 12*a*. As described in the above-referenced '860 and '120 patents, image member 12 is heated so as to maintain the ink in a molten state on recording surface 12*a* the molten ink adhering to the surface at those charged areas.

As will be described in more detail below, the amounts of ink to be picked up by the charged areas on recording surface 12*a* are proportional to the electric field intensities emanating from those charged areas. This variation of field intensities over the image on the recording surface 12*a* facilitates reproduction of a full gray scale.

As the image member 12 continues to rotate, the developed portion of the image on recording surface 12*a* advances to the ink transfer station 18 constituted by the nip formed by cylinders 10 and 12. Controller 24 controls the position of the image on image member 12 so that when that image is developed and advances through the nip, the developed image thereon is transferred to the proper location on the web W. There is a total transfer of the ink from recording surface 12*a* to the web W at the transfer station 18 because the transfer is accomplished thermodynamically by means of a phase transformation of the ink which switches from a hot melt liquid condition to a solid state condition at the line of contact with the relatively cool web W.

The charged areas of the recording surface 12*a*, now devoid of ink, are advanced past erase station 22. This station contains means, such as an ultraviolet light, for rendering the recording surface 12*a* conductive so that the charges thereon dissipate. Thus, when the recording surface 12*a* exits station 22, it is completely discharged and ready for re-imaging by write head 14 during the next or a subsequent revolution of image member 12. In the meantime, an image representing one color component, e.g, the cyan component, of the original image will have been printed on web W.

The apparatus shown in FIG. 1 differs from the printing apparatus described in the above-referenced patents primarily in two of its elements: the write head 14 and the image member 12. With the present invention, write head 14 comprises an array of whisker matrices (charge members), each having at least one whisker, arranged to resiliently engage the recording surface 12*a* of image member 12. The controller 24 functions so as to apply imagewise-dependent voltages to the various contacts at the instant they are disposed opposite respective pixel regions of the recording surface.

Figure 2:
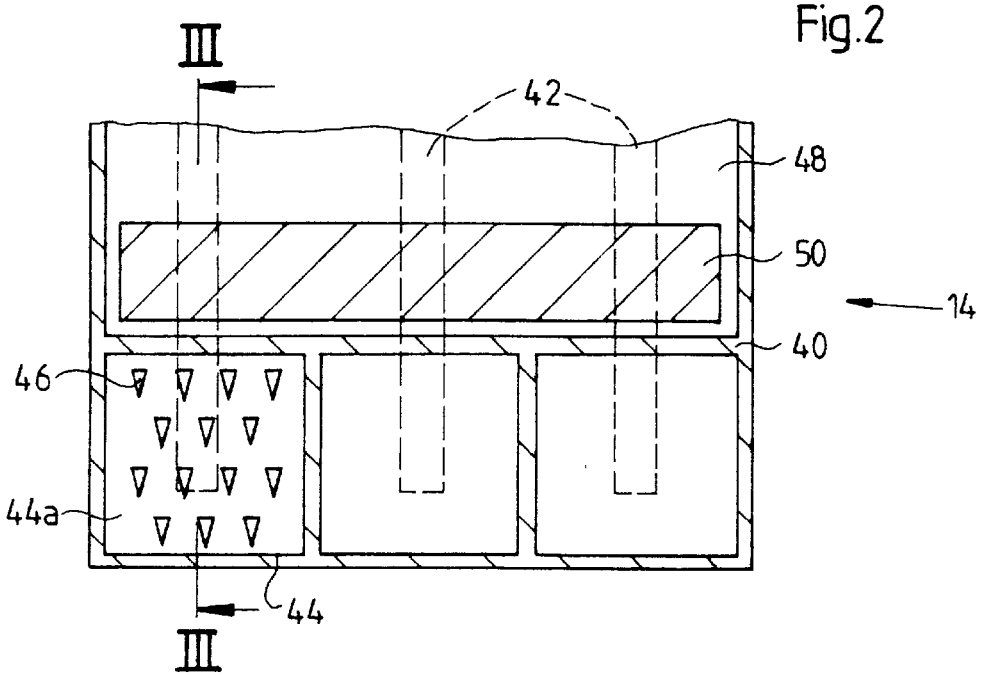
FIG. 2 is a bottom view of the print head embodiment for the FIG. 1 apparatus.
Figure 3:
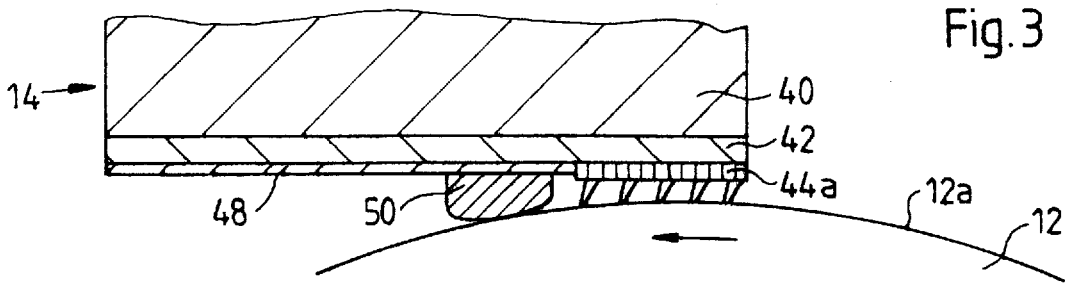
FIG. 3 is a sectional view taken on line 5—5, on a much larger scale, showing the write head of FIG. 2 in association with an image member.

FIGS. 2 and 3 show the whisker write head 14 in more detail. A support member 40 of an insulating material extends the full width of the image member 12. Deposited on the support member 40 is a series of distinct conductive lead films 42, each one serving as a voltage lead to the controller 24 for one matrix or pad 44 of conductive whiskers 46, thereby providing means for charging the matrix 44 in accord with the electronic image. These films may be formed, for example, by etching a continuous metal layer deposited onto the substrate 40. Each whisker matrix 44 comprises a conductive substrate 44*a*, in electrical communication with its respective, lead film 42 and an array of whiskers 46 grown thereon. The footprint of each whisker array corresponds to and defines the area of a pixel region in the image. The portion of a lead film 42 not covered by a substrate is protected by an insulating layer 48. The sliding force on the write head 14 due to the rotation of the image member 12 is absorbed by a glide shoe 50 which rides on the image member recording 12*a* surface during a write operation.

The flexibility of the whiskers 46 assures gentle mechanical contact with the recording surface as the image member rotates past the write head 14. Experiments with graphite whiskers have indicated that there is a strong electrostatic attraction between a whisker and the recording surface 12*a* of an image member 12 having a ground plane, such as is described below. Providing that the recording surface 12*a* is free of dust or chemical contaminants or thick insulating films, the whiskers do not bounce off or fail to establish intimate contact with the recording surface. Rather, the electrostatic attraction of a flexible whisker by the charges deposited on the recording surface 12*a* deflects the whisker toward the recording surface, thereby promoting electrical contact.

The whiskers are made of a strong, ultra-hard, usually monocrystalline material, which extend generally perpendicular from the conductive substrate 44*a*, as shown in FIG. 3. The whiskers may be grown by any of the methods known in the materials processing field, including for example the methods described in D. Stewart and P. Wilson, "Recent developments in broad area field emission cold cathodes," *Vacuum*, Vol. 30 No. 11/12 and H. E. Cline, "Multineedle Field Emission from the Ni-W Eutectic," *Journal of Applied Physics*, Vol. 41, No. 1 (January 1970), which are herewith incorporated by reference. The whiskers may be of any of several appropriate materials, such as tungsten or graphite. In addition to adequate electrical conductivity, whiskers for use in a writing head must be flexible and chemically stable.

Unlike the image members described in the '120 and '314 patents referenced above, the image member 12 has an anisotropic recording surface 12*a* so that the electric charges acquired from the write head 14 during a write operation distribute themselves on the recording surface 12*a* nonuniformly thereby forming electric fields which extend above the surface of the image member. Thus, when the image member 12 is rotated to position these nonuniformly charged areas opposite the inking head 16, the charged areas take ink from the inking head by the process of dielectrophoresis. That is, the ink particles are polarized by the nonuniform fields at the recording surface 12*a* and are drawn to the areas on cylinder surface 12*a* where the fields are strongest in amounts monotonically increasing with the field strengths at those charged areas.

Figure 4:
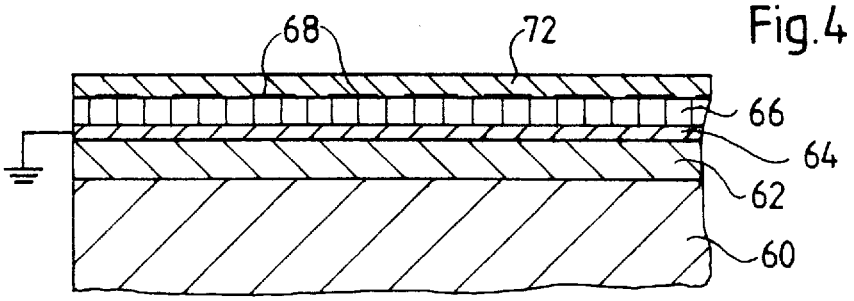
FIG. 4 is a fragmentary sectional view of the preferred recording surface.

As best seen in FIGS. 1 and 4, image member 12 comprises a rigid core 60 which may be of steel or aluminum. Preferably, the core is slotted as shown to reduce its weight and to allow for the circulation of air through the core to cool it. Surrounding core 60 is a sleeve 62 of a material which is a good thermal and electrical insulator such as ceramic. Deposited onto the surface of sleeve 62 is a layer 64 of conductive material such as copper metal. This conductive layer functions as a ground plane for the image member 12.

Surrounding layer 64 is a thin, e.g., 1 $\mu$m, layer 66 of a dielectric material having very high electrical resistivity, such a silicon nitride or sapphire. Layer 66 is rendered anisotropic by forming a pattern of conductive islands 68 on the dielectric layer 66. These islands are electrically insulated from the conductive layer 64 and from one another. The islands 68 can be formed as tiny short conductive spots, wires or paths applied to the surfaces of the dielectric layer 66. Other methods to render the surface anisotropic, such as metal embedded within the dielectric layer are also possible, as long as the surface has areas of varying conductivity. While the whisker write head is preferably used with an anisotropic surface, some advantages of the whisker write head, such as increased durability over a metal contact write head, may also be achieved if used solely on a plain homogenous dielectric surface. FIG. 4 also shows that image member 12 may be provided with a very thin outer coating 72 of an abhesive material such as polytetrafluoroethylene (Teflon) which is inkophobic. This abhesive surface coating 72 prevents ink from adhering to non-charged areas of the cylinder surface 12*a* and also minimizes ink smear on that surface, although it may diminish the desired charge transfer from the whiskers to the image member surface.

Figure 5A:
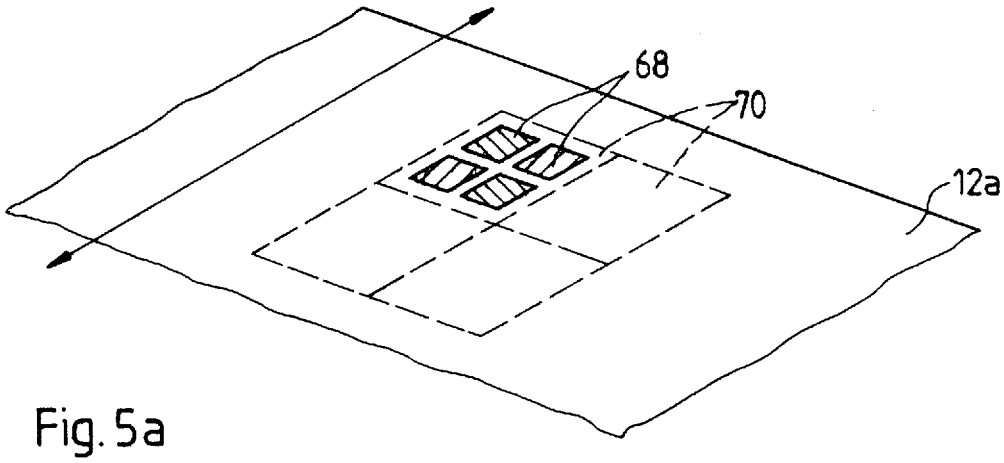
FIGS. 5A and 5B are isometric views of a portion of an anisotropic recording surface with conductive islands, FIG. 5B including a simplified representation of the write head of FIGS. 2 and 3.

FIG. 5A shows a possible arrangement of islands 68 in a pixel region 70: in columns and rows in a rectilinear pattern, e.g., 2×2 islands per pixel region 70. For ease, of illustration, these islands 68 are shown in the drawing figures to be relatively large and widely spaced apart. In actuality, however, the islands may be less than 1 $\mu$m in diameter and be spaced only a few $\mu$m apart. Obviously, however, other patterns may be used. The island pattern for each pixel region may be periodic or entirely random. However, the island 68 should be of sufficient size compared to the write head whiskers 46 so as to ensure the necessary contact between the contacts and the image surface during passage of the write head over each pixel region 70. FIG. 5A shows the cylinder surface 12*a* without an abhesive coating.

Figure 5B:
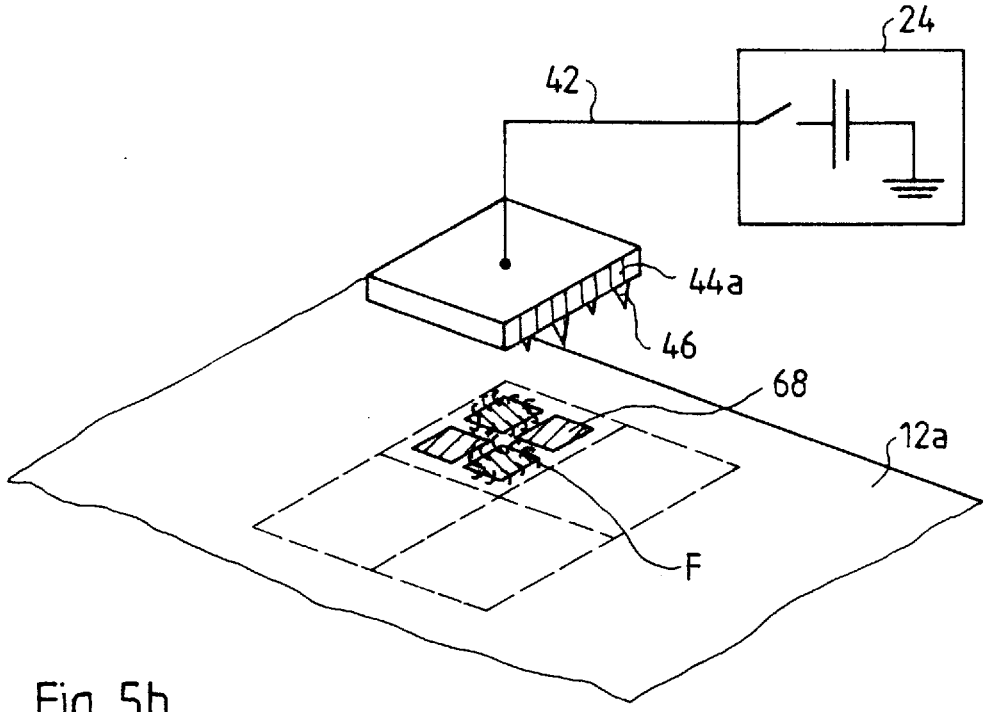

Thus, contact by the sliding whiskers of write head 14 writes an electronic image directly onto an anisotropic recording surface 12*a* of image member 12 in the following manner. The imagewise-dependent voltages applied to the whiskers 46 impart charge to the conductive islands 68 of the pixel regions 70 in accordance with the electronic images. FIG. 5B illustrates the pixelwise operation of the whisker write head shown in FIGS. 2 and 3. Each whisker 46 can be quite small because it only needs to contact the corresponding island 68 at one point for a very short time (in the order of nanoseconds) in order for the conductive island to become completely charged to the full potential of the corresponding whisker 46. Field lines F will emerge transversely from the spots and attract ink around the spots. The presence of the islands thus greatly enhances the effectiveness of the image member 12 because stronger fields can be produced as compared to those that would be produced by the narrow line contacts 30 on a plain dielectric surface. The potential around each spot will be closer to ground potential (desirable for producing high-transverse fields), the thinner the dielectric layer 66.

Thus, when the charged areas of the cylinder 12 are rotated opposite the inking head 16, the nonuniform electric field at each spot position will polarize the developing medium and draw ink particles to cylinder surface 12*a* by dielectrophoresis in an amount monotonically increasing with the charge at each spot.

It is also possible to deposit a nonuniform charge distribution onto recording surface 12*a* by pulsing the writing voltage between zero and the desired voltage level several times within the residence time of the write head 14 within a single pixel region. An AC voltage source applied at 300 Hz while the image member surface is traveling at a speed one meter per second would be appropriate to produce these pulses.

A print member with a charged anisotropic surface described above can interact with a dielectric developing medium or any other dielectric material with a dielectric constant greater than one. Thus, although we have described the present invention as used in printing apparatus incorporating an inking station which dispenses thermoplastic inks, the described print members can also be used to receive solid uncharged dielectric inks and charged or uncharged toners which are dispensed in bulk or as an aerosol.

It will therefore be seen that the foregoing represents a highly advantageous approach to the design and manufacture of inks for electrothermal printing. As stated above, it is also conceivable that the whisker write head be used with an image member having a plain, uniform dielectric surface. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. An apparatus for writing an electrostatic pattern corresponding to an electronic image comprising:

an image member having a recording surface; and a write head for transferring electrostatic charges onto the recording surface, the write head having a plurality of whiskers for contacting the recording surface, the recording surface being an anisotropic dielectric surface.

2. The apparatus as recited in claim 1 further comprising an ink transfer station for transferring ink to the image member.

3. The apparatus as recited in claim 2 wherein the ink is an uncharged ink.

4. The apparatus as recited in claim 1 wherein the write head further comprises a glide shoe for contacting the recording surface.

5. An apparatus for writing an electrostatic pattern corresponding to an electronic image comprising:

an image member having a recording surface; and a write head for transferring electrostatic charges onto the recording surface, the write head having a plurality of whiskers for contacting the recording surface;

the image member including a conductive layer; a dielectric layer disposed over the conductive layer; and conductive islands disposed on the dielectric layer.

6. An apparatus for writing an electrostatic pattern corresponding to an electronic image comprising:

an image member having a recording surface; and a write head for transferring electrostatic charges onto the recording surface, the write head having a plurality of whiskers for contacting the recording surface;

the write head including a series of conductive pads, each pad having at least one whisker extending therefrom.

7. The apparatus recited in claim 6 wherein the recording surface is a plain dielectric surface.

8. The apparatus as recited in claim 6 where each pad comprises a plurality of whiskers.

9. The apparatus as recited in claim 6 wherein each pad corresponds to a pixel to be written on the recording surface.

10. An apparatus for writing an electrostatic pattern corresponding to an electronic image comprising:

an image member having a recording surface; and a write head for transferring electrostatic charges onto the recording surface, the write head having a plurality of whiskers for contacting the recording surface;

the whiskers being of one of graphite and tungsten.

11. An apparatus for writing an electrostatic pattern, corresponding to an electronic image, comprising:

an image member having a recording surface; and a write head for transferring electrostatic charges onto the recording surface, the write head having an array of charge members for writing on the recording surface, each charge member having at least one whisker extending therefrom;

the image member including a conductive layer; a dielectric layer disposed over the conductive layer; and conductive islands disposed on the dielectric layer.

12. An apparatus for writing an electrostatic pattern, corresponding to an electronic image, comprising:

an image member having a recording surface; and a write head for transferring electrostatic charges onto the recording surface, the write head having an array of charge members for writing on the recording surface, each charge member having a plurality of whiskers extending therefrom.

13. The apparatus as recited in claim 12 further comprising an ink transfer station for transferring ink to the image member.

14. The apparatus as recited in claim 13 wherein the ink is an uncharged ink.

15. The apparatus as recited in claim 12 wherein the recording surface is a plain dielectric surface.

16. An apparatus for writing an electrostatic pattern, corresponding to an electronic image, comprising:

an image member having a recording surface; and a write head for transferring electrostatic charges onto the recording surface, the write head having an array of charge members for writing on the recording surface, each charge member having at least one whisker extending therefrom;

the recording surface being an anisotropic dielectric surface.

* * * * *